US005142290A

United States Patent [19]

DuFort

[11] Patent Number: 5,142,290

[45] Date of Patent: Aug. 25, 1992

[54] WIDEBAND SHAPED BEAM ANTENNA

[75] Inventor: Edward C. DuFort, Fullerton, Calif.

[73] Assignee: Hughes Aircraft Company, Los Angeles, Calif.

[21] Appl. No.: 552,645

[22] Filed: Nov. 17, 1983

[51] Int. Cl.[5] ..... H01Q 3/22; H01Q 3/24; H01Q 3/26

[52] U.S. Cl. ..... 342/372; 343/911 L

[58] Field of Search ..... 343/911 L, 780, 773, 343/754, 368, 372

[56] References Cited

U.S. PATENT DOCUMENTS

| | | | |
|---|---|---|---|
| 3,343,171 | 9/1967 | Goodman, Jr. | 343/754 |
| 3,656,165 | 4/1972 | Walter et al. | 343/754 |
| 3,680,123 | 7/1972 | Bryant et al. . | |
| 3,680,140 | 7/1972 | Chalfin et al. | 343/754 |
| 3,754,270 | 8/1973 | Thies, Jr. | 343/773 |
| 4,114,162 | 9/1978 | Wild | 343/754 |
| 4,146,895 | 3/1979 | Wild | 343/754 |
| 4,255,751 | 3/1981 | Goodman, Jr. | 343/754 |
| 4,268,831 | 5/1981 | Valentino et al. | 343/754 |
| 4,359,738 | 11/1982 | Lewis | 343/754 |
| 4,359,741 | 11/1982 | Cassel | 343/754 |
| 4,488,156 | 12/1984 | DuFort et al. | 343/754 |

OTHER PUBLICATIONS

"The Geodesic Luneberg Lens" by Richard C. Johnson, The Microwave Journal, Aug., 1962, pp. 76-85.

"A Solution of the Problem of Rapid Scanning for Radar Antennae" by R. F. Rinehart, Journal of Applied Physics, vol. 19, Sep., 1948 pp. 860-862.

*Primary Examiner*—Theodore M. Blum

*Attorney, Agent, or Firm*—Wanda K. Denson-Low

[57] ABSTRACT

A wideband shaped beam antenna having steep beam edge slopes in one plane is disclosed. An optical multiple beam antenna such as a geodesic lens antenna, a Luneberg lens or a circular folded pillbox, is coupled at selected points to a feed system having a power divider and phasing control. Coupling of the feed system to the optical multiple beam antenna is effected with a power transition having a wide frequency bandwidth and a capability of conducting high power levels. To shape the beam further, selected beams may be amplitude weighted. An aperture control device such as an E-plane sectoral horn, is attached when required, to narrow the beamwidth in the E-plane. By overlapping multiple beams of the optical multiple beam antenna in accordance with the invention, a sector beam having a constant position and constant steep edge slopes over an octave frequency bandwidth is obtained.

25 Claims, 6 Drawing Sheets

WIDEBAND SHAPED BEAM ANTENNA

BACKGROUND OF THE INVENTION

The invention relates to shaped beam antennas and in particular, to an antenna for forming a sector beam, the shape and position of which are constant over a wide frequency bandwidth.

Shaped beam antennas are useful for many purposes, one of which is efficient energy management. These antennas are becoming more useful in other areas as the sophistication of radar systems increases. The capabilities of precision direction finding and resolution of complex targets where only limited scanning time is available are becoming more and more necessary in view of the speeds and radar capabilities of modern threats. For example, one defense against a radar equipped threat is to steer it off target. However, the effectiveness of signals transmitted to steer the threat off target can depend upon multipath propagation effects which alter the transmitted beam. Multipath propagation can cause fluctuation of 10 to 20 dB, which may distort the antenna beam to a point where it becomes ineffective. The multipath effect becomes a significant consideration in relation to threats which fly low to the ground or water, or close to other stationary clutter.

Multipath fluctuations can be reduced significantly by employing shaped beam antennas which provide steep beam slope or cut off characteristics near the clutter position. For example, where the antenna is located on a ship, a steep beam slope in the elevation plane near the water would be desirable in relation to low flying threats.

In addition, since the frequency or frequencies of the radar system of the threat are typically unknown, a wide frequency bandwidth in the shaped beam antenna is also desirable. Coupling a wide frequency bandwidth with a constantly shaped beam where the beam position and shape are independent of frequency over the wide frequency bandwidth would result in an antenna well adapted for use in high multipath environments.

The principles of geometric optics have been the design basis for prior shaped beam antennas. One prior optical technique involves the offset feed parabolic antenna. A point source whose radiation pattern is known illuminates a reflector shaped such that the feed energy is redistributed into the desired far field shape. These reflectors may also be shaped to provide a narrow beam in the orthogonal plane. This technique is described in more detail in Silver, *Microwave Antenna Theory and Design*, McGraw-Hill, NY, 1949, pg. 497 et seq. The advantage of this technique is simplicity and low cost. However, the feed pattern is a function of the product of the wave number $k=(2\pi/\lambda)$ and the sine of the angle $\theta$, so the beam position and shape in the far field vary with frequency as $k \sin \theta$.

In order to retain a constant far field pattern, a constant feed pattern would be required and this is difficult to obtain. If a nonfocal feed were used, for example an array on a spherical cap, the feed would be broadband, however points on the feed generally would not produce focused pencil beams in the far field, and sharp beam edges would not be obtained. A prior optical technique is radiating directly from a spherical surface. This produces constant beamwidth and constant beam shape over a wide frequency bandwidth, however, again the sharp beam edges have not been obtained.

The above described techniques are based on providing a single beam and shaping that beam as required. Another prior technique involves a constrained approach such as using a corporate or series type transmission line or a waveguide power divider to feed a planar or linear aperture, such as in the Butler beam forming array. Any realizable far field pattern can be produced using this technique and if the Woodward synthesis is used, the aperture size will be small and the edge shape will be the steepest possible corresponding to the aperture size. However, in this approach, the aperture distribution is constant with frequency, therefore the far field pattern shape will vary as $k \sin \theta$. Also in this technique, operating over too wide a frequency band changes the beamwidth, shifts the location of the beams and can introduce grating lobes just as with any array antenna. In particular, the beamwidth will typically be broadened by a factor of two over a frequency bandwidth of an octave.

A variant of the above described constrained approach is given in U.S. Pat. No. 4,146,896 to Wild (1979), where a spherical cap feeds a planar array. As discussed above, the use of a planar array causes a narrow frequency bandwidth for the structure. Also the beams are not fixed in position and will vary with frequency. In order to obtain a steep beam slope plus a one-half octave or greater frequency bandwidth, the antenna would need an aperture of several hundred wavelengths, which is an impracticable structure in most cases.

SUMMARY OF THE INVENTION

It is a purpose of the invention to overcome most, if not all, of the above described problems of prior techniques by providing an antenna having a sector beam which remains constant in shape and position over a wide frequency band and which has steep edge slopes.

It is another purpose of the invention to provide a shaped beam antenna capable of conducting relatively high power levels.

It is another purpose of the invention to provide an antenna which is relatively small in size, simple in construction, light in weight and of low manufacturing cost.

The invention accomplishes the aforementioned purposes and other purposes by providing a wide frequency bandwidth antenna system having an optical multiple beam antenna with an antenna feed system having a power divider, phasing control and a wide frequency band power transition from the phasing control to the optical multiple beam antenna and, where required, an aperture control to narrow the beamwidths.

In the invention, an optical multiple beam antenna is used to obtain a sector beam which has constant beam position and beam shape over a wide frequency band. The sector beam is formed by simultaneously generating and overlapping a series of selected beams of the optical multiple beam antenna so that the overlapping results in a sector beam of the desired shape. Since the antenna used in the invention operates in accordance with the principles of optics, the individual beam positions of the series of overlapping beams are fixed in space and are independent of the operating frequency. In the invention, the sector beam position and beam shape remain nearly constant over an octave frequency bandwidth. Some examples of optical multiple beam antennas usable in the invention are a geodesic lens antenna, a Luneberg lens antenna, a circular folded pillbox and a Myer trash can scanner.

The shape of the sector beam is controlled in part by the number of the feeds to the optical multiple beam antenna. Since the sector beam is formed by overlapping multiple beams, the number of feeds and placement of them in relation to one another determine the degree of overlapping of the beams and thus the sector beam size.

In the invention, a phase progression technique is provided to compensate for ripple. In the phase progression technique, a phasing control is coupled to the antenna feeds for varying the ripple. By use of the phasing control, the optical multiple beam antenna may be suitably defocussed or phase spoiled such that constant beamwidth and constant edge slope are obtainable.

A power divider is used to feed the optical multiple beam antenna through the phasing control means and may have weighted outputs for energy management or other purposes. For example, more weighting can be given to the beams located just above the horizon and less weighting given to higher angle beams where less elevation gain is required.

The optical multiple beam antennas usable in the invention typically have broad beamwidths in the plane orthogonal to the plane of the multiple beams and an aperture control device may be coupled to the optical multiple beam antenna to limit this beamwidth as desired. An aperture control device consisting of an E-plane sectoral horn having a selected flare angle operates in accordance with the laws of optics and has been found to be useful for limiting the E-plane beamwidth of a geodesic lens antenna. The flare angle of the horn is approximately equal to the beamwidth.

There are two general varieties of optical multiple beam antennas usable in the invention, perfectly focussing and imperfectly focussing antennas. Both types meet the purposes of the invention because their beam positions are not frequency dependent, however they possess somewhat different operating characteristics. The perfectly focussing multiple beam antenna is a lens antenna such as the geodesic and Luneberg lenses, and it has been found that these antennas have sharper beam edge slopes than the imperfectly focussing antennas, however the individual beam shapes change slightly with frequency changes. The imperfectly focussing multiple beam antennas such as a trash can scanner, a folded circular pillbox, or a constant k lens, produce nearly constant phase fronts. It has been found that these antennas can be constructed to maintain a constant beam shape with frequency changes although the beam edge slope is not as steep as with the perfectly focussing antennas. The imperfectly focussing multiple beam antennas also tend to have less ripple, although ripple can be compensated for in the perfectly focussing antennas through the phasing control.

Typically, the optical multiple beam antenna and other elements of the invention are capable of use in both the transmission and reception of electromagnetic energy. For convenience it is customary to refer to such elements in terms of their functions in the transmission of electromagnetic energy while understanding that they are also capable of reception.

The novel features which are believed to be characteristic of the invention, both as to its structure and method of operation, together with further purposes and advantages thereof will be better understood from the following descriptions considered in connection with the accompanying drawings.

BRIEF DESCRIPTION OF THE DRAWINGS

FIG. 5*a* presents a typical E-plane pattern where no aperture control is utilized and FIG. 5*b* presents the E-plane pattern with an E-plane sectoral, flared horn attached to the geodesic lens antenna;

FIG. 8*a* shows a coaxial shorted probe feed while FIG. 8*b* shows the schematic circuit equivalent of a feed similar to FIG. 8*a*;

DETAILED DESCRIPTION OF THE INVENTION

Figure 1:
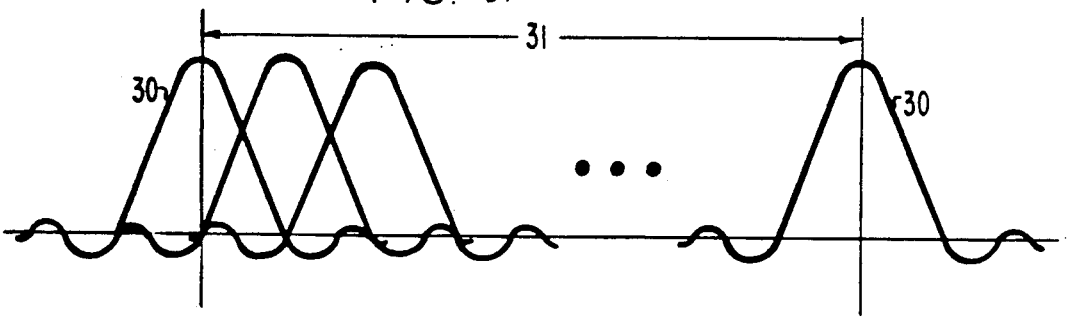
FIG. 1 is a chart of superimposed (sin X)/X beams to form a sector beam pattern.

Referring now to the drawings with more particularly, FIG. 1 presents a view of overlapped (sin X)/X beams. Without subscribing to any particular theory of operation, it appears that the mechanics of operation of the invention are as generally described in the following paragraphs.

A shaped sector beam having a steep beam edge slope can be realized by overlapping adjacent (sin X)/X type beams. The sector pattern is exact at the peaks of the constituent (sin X)/X since the neighboring beams have nulls at these points. This is the basis of the Woodward pattern synthesis and is shown in FIG. 1. The edge slopes 30 of the sector 31 are determined primarily by the slope or beamwidth of a single constituent beam. Also, the number of sample points in the sector beam, hence the fidelity of the synthesis, is determined by the width of the constituent beams. The Woodward viewpoint shows how much aperture is required to produce edge slope. Since the constituent beams are diffraction limited and the edges of the sector beam have roughly the same slope as the constituent (sin X)/X beams, the Woodward viewpoint leads to the smallest aperture required to produce a required beam edge slope. The slope of the pattern is approximated by the formula:

$$\frac{dP}{d\phi} \simeq \frac{D}{4\lambda}\ dB/\text{degree}$$

where:

P = relative power level in dB in the far field $\phi$ = angle in degrees $D/\lambda$ = aperture size in wavelengths On the other hand, the edge slope of an optical antenna such as a horn fed hyperbola or a large, directly radiating, sectoral horn has an edge slope of the form:

$$\frac{dP}{d\phi} \simeq \frac{1}{7}\left(\frac{D}{\lambda}\sec\phi_0\right)^{\frac{1}{2}}$$

Where $\phi_0$ is the beamwidth. This square root relationship produces gently sloping edges, therefore, the Woodward synthesis produces the steeper slope. Woodward synthesis is not entirely a convenient algorithm for synthesis. Since a Butler matrix will produce adjacent (sin X)/X beams, a narrow band, direct Woodward mechanization can be constructed by attaching a weighted output to the Butler matrix in a one to one accordance with the desired far field beam weighting.

The ideal Butler and ideal corporate feed will produce an aperture distribution which is constant for all frequencies, but such a distribution would produce a beam which is a function of k sin $\theta$. The Butler beam positions and beamwidths will dilate with frequency causing a broadening of the sector beam and a change in the edge slope. This pattern "breathes" with frequency, the cause of which is that the constituent (sin X)/X Butler beams are not fixed in space or fixed in beamwidth as the frequency changes.

Figure 2:
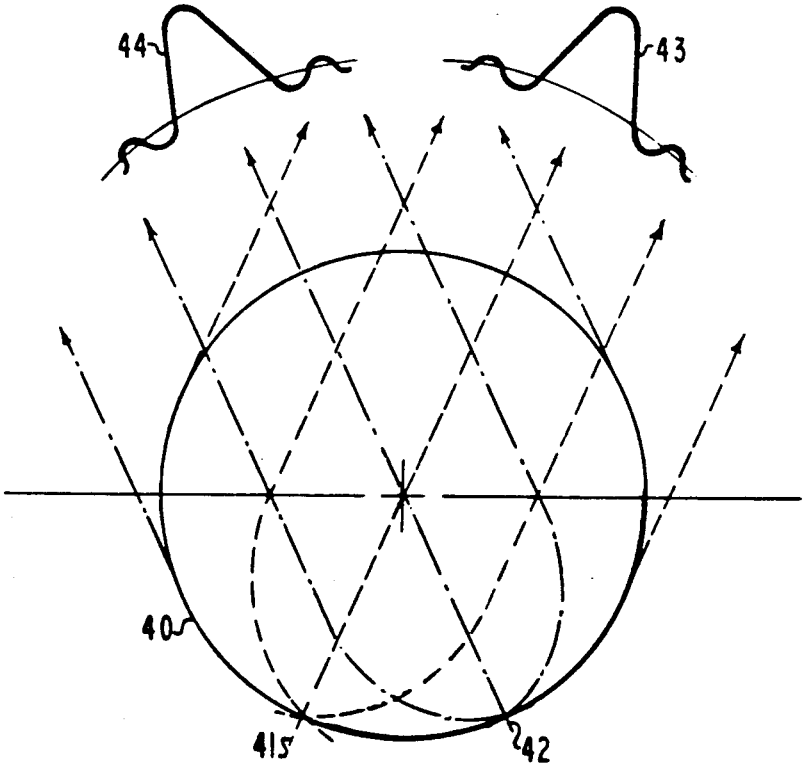
FIG. 2 is a schematic view of a geodesic lens having two feed probes and the resultant far field beam shapes.
Figure 3A:
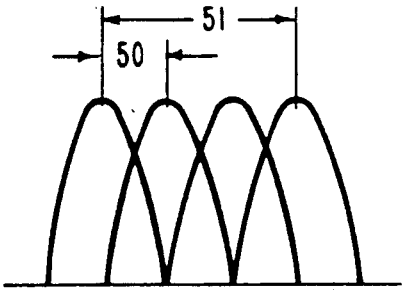
FIGS. 3*a* and 3*b* are graphs of beam shapes of a typical Butler beam forming array showing the frequency dependence of individual and sector beam shapes.
Figure 3C:
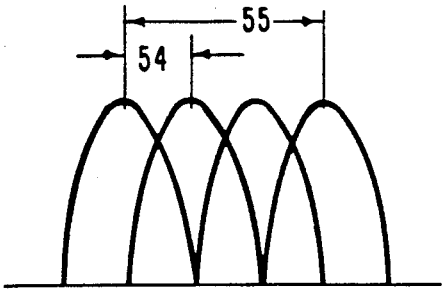
FIGS. 3*c* and 3*d* are graphs of beam shapes of an antenna constructed in accordance with the invention.
Figure 3B:
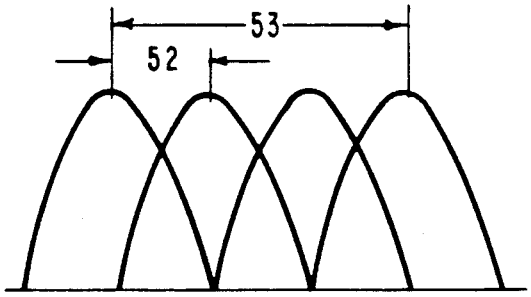
Figure 3D:
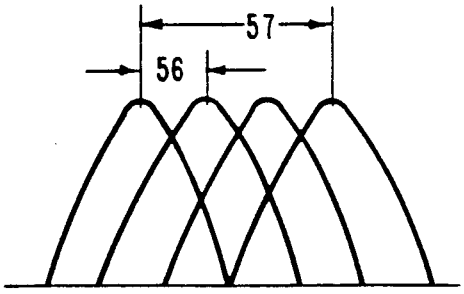

There is a close relationship between a Butler matrix, which is a multiple beam antenna feed, and an optical multiple beam antenna such as a geodesic lens or a two dimensional Luneberg lens. These latter antennas may be considered as being the optical analog to the Butler matrix. Feed points spaced one half wavelength apart on a geodesic lens with a cosine feed power pattern will produce (sin X)/X beams as in the Butler matrix. However, in the geodesic lens, the beam positions are fixed in space and are determined by the angle of the feed as schematically shown in FIG. 2. Geodesic lens 40 has feeds 41 and 42 located on its focal curve. From these feeds, far field beams 43 and 44 are generated respectively. In the geodesic lens, as in the Luneberg lens, the individual beams such as beams 43 and 44 in FIG. 2, will change beam slope with frequency somewhat, but since their positions are fixed in space, the sector beam shape, measured between outer beam centerlines as shown in FIG. 1 by sector 31, is constant. Only the sector beam edge slope changes with frequency and not the sector beam width. This characteristic is shown in FIGS. *3a–3d*.

In FIG. *3a*, the width 50 between constituent beams of sector beam 51 generated by a typical Butler beam forming array is shown. In FIG. *3b*, the frequency of operation has been reduced from that of FIG. *3a* and results in a wider width 52 between constituent beams and a wider sector beam 53 than that of FIG. *3a*. Changing the frequency of operation in the opposite direction yields opposite results, i.e., a narrowing of both widths. In the invention, an optical multiple beam antenna is used which has fixed beam positions. A selected number of overlapped beams are simultaneously generated to form the sector beam in space. The results of changing the frequency of operation in this antenna are shown in FIGS. *3c* and *3d*. In FIG. *3c*, the width 54 between constituent beams and the width of sector beam 55 are shown. In FIG. *3d*, the frequency of operation has been reduced from that of FIG. *3c*. The width 56 between the constituent beams remains the same as width 54 in FIG. *3c* and the sector beamwidth 57 remains the same as the sector width 55 of FIG. *3c*, even though the constituent beams have changed shape somewhat.

Multiple beam antennas which are usable in the invention may be classified as two general types; perfectly focussing and imperfectly focussing. Examples of the perfectly focussing type are the geodesic lens antenna and the Luneberg lens antenna. Both are known in the art, e.g., see Jasik, *Antenna Engineering Handbook*, McGraw-Hill, 1961, pgs. 15-3 to 15-10. It has been found that the perfectly focussing type may be characterized as having steeper beam slopes than the imperfectly focussing type, however the slopes change more with frequency than with the imperfectly focussing type. Also, it has been found that ripple across the sector beam is higher with a perfectly focussing type antenna.

Figure 4:
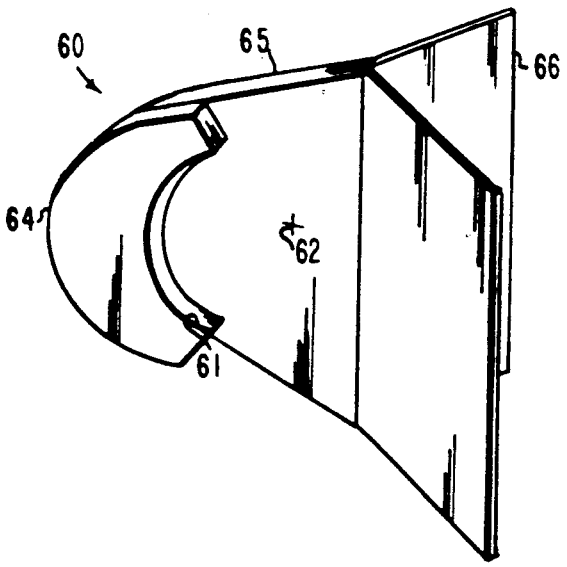
FIG. 4 presents a perspective view of a circular folded pillbox type antenna usable in the invention.
Figure 5A:
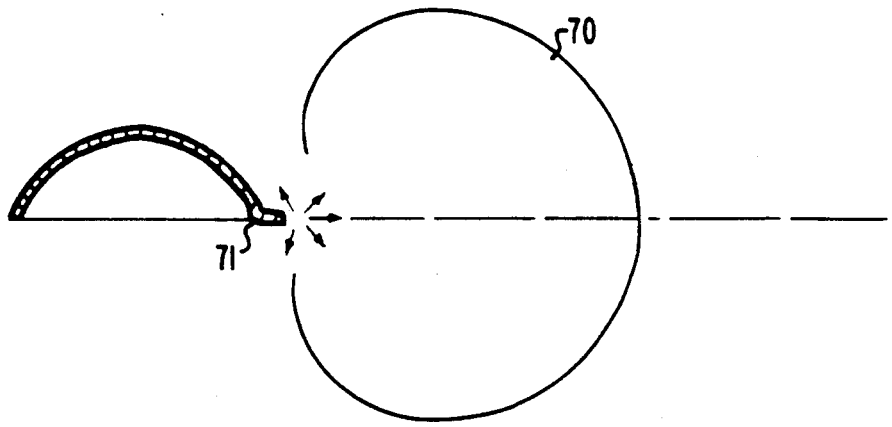
FIGS. 5*a* and 5*b* present the radiation patterns in the E-plane of a geodesic lens antenna usable in the invention
Figure 5B:
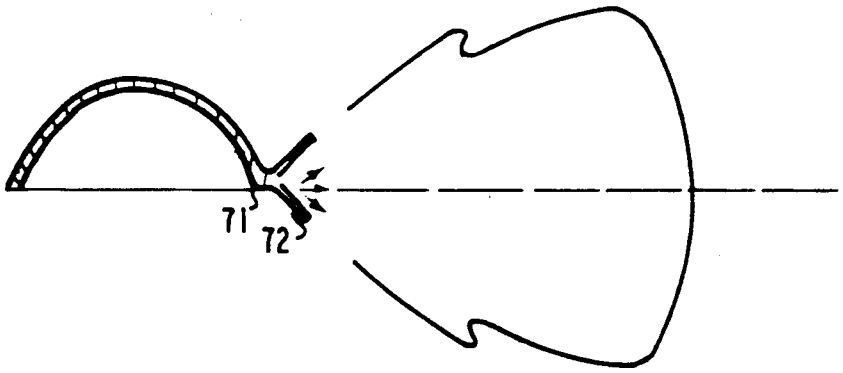

The imperfectly focussing type multiple beam antennas such as reflectors and constant k dielectric lenses have nearly constant phase fronts. It has been found that where an imperfectly focussing multiple beam antenna such as a circular folded pillbox or a trash can scanner is used, the edge slope will remain relatively constant with frequency change. However, as discussed, it has been found that the edge slope is not as great as in the perfectly focussing multiple beam antennas but there is a decrease in ripple through the sector beam. A folded circular pillbox type antenna usable in the invention is shown in FIG. 4. Pillbox 60 has a feed circle 61 centered from point 62. Circular reflector 64, also centered from point 62 but with about twice the radius of feed circle 61, is connected to waveguide horn 65 and to aperture control 66 which narrows the beam in the E-plane. A more detailed discussion of a pillbox antenna is located in S. Silver, *Microwave Antenna Theory and Design*, Vol. 12, Radiation Laboratory Series, McGraw-Hill, N.Y., 1949, pgs. 459–464. For a more detailed description of the trash can scanner, refer to S. B. Meyer, "Journal of Applied Physics," Vol. 18, 1947, pg. 221.

When using an optical multiple beam antenna such as a geodesic lens in the invention, the pattern in the plane orthogonal to the plane of the multiple beams is typically very broad. FIG. *5a* shows the radiation pattern 70 which is typical in a geodesic lens with no aperture control on the periphery 71. When a more directional pattern is desired, an aperture control such as horn 72 in FIG. *5b* may be coupled to periphery 71. A horn such as horn 72 is believed to be particularly useful in the invention since it operates in accordance with the principles of optics. Horn 72 is a well-known E-plane sectoral horn and is shown reducing the beamwidth in FIG. *5b*, but with gentle edge slope. To sharpen the beam edges, a large horn would be required since the slope is based on $(kD)^{\frac{1}{2}}$ in the E-plane, where k is the wave number and D is the aperture dimension. Other types of aperture controls may be used in the invention including a line source, a lens, a shaped offset reflector, or an array.

Figure 6:
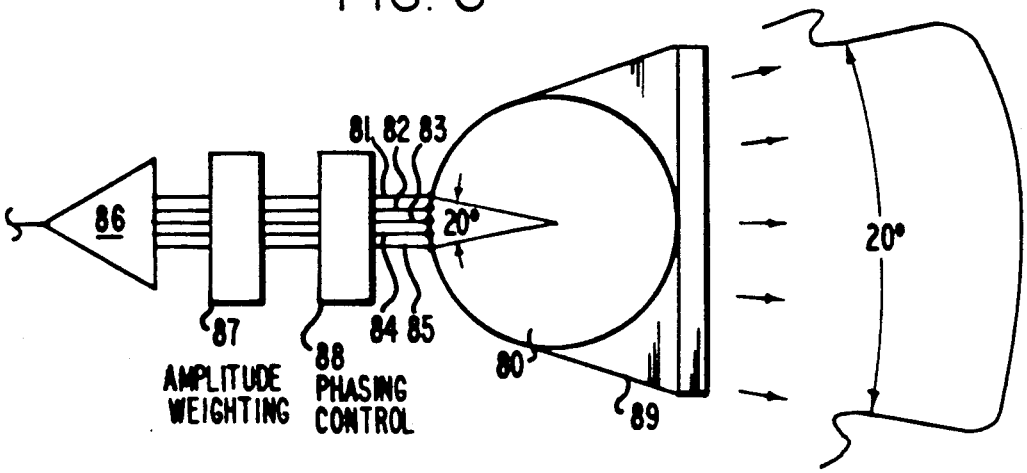
FIG. 6 is a schematic view of the radiation pattern of a Luneberg lens usable in the invention having feeds spaced over 20° of the lens periphery.

As was previously discussed, the size of the sector beam of the antenna in accordance with the invention, depends upon the number and location of the feeds to the multiple beam antenna. For example, where a sector angle of 20° is desired, feed horns spanning 20° of the periphery of a Luneberg lens antenna may be used as shown diagrammatically in FIG. 6. These horns will produce a 20° far field pattern with steep edge slope. This technique is also applicable to the folded circular pillbox antenna such as that shown in FIG. 4 where the sector beam angle is determined by the angle of the feed circle 61 used and the number of horns used. FIG. 6 show diagrammatically the five feed horns 81–85 are used. The use of five feed horns is shown for explanation purposes only. It has been found that feeds spaced at one-half wavelength or less, of the highest frequency of operation produce a desirable sector beam in the invention.

Figure 7:
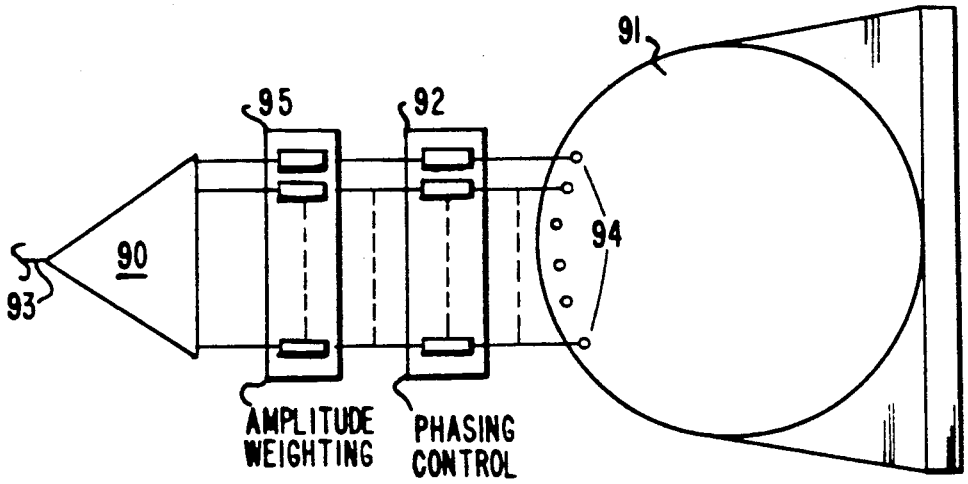
FIG. 7 presents a schematic block diagram of an antenna system constructed in accordance with the invention.

A shaped beam antenna in accordance with the invention is schematically shown in FIG. 7 where power divider 90 is feeding a geodesic lens antenna 91 through phasing control device 92 and amplitude weighting device 95. The signals are coupled to the geodesic lens antenna 91 by feed probes 94. As discussed, it has been found that feeds spaced from each other by one-half wavelength or less at the highest frequency of operation create a sector beam with steep beam edge slopes. Power divider 90 divides the input signal from feed line 93 into the number of signals corresponding to the number of feed probes used in the particular embodiment. Where energy management is a concern, the output signals of power divider 90 may be amplitude weighted by amplitude weighting device 95. For a pattern where more energy is to be transmitted to the lower elevation angles than to the higher elevation angles, proper weighting of power divider outputs can achieve this pattern. Power dividers usable in the invention include waveguide types, coaxial line types, stripline, radial line, E-plane separated waveguide and others known in the art. Amplitude weighting devices are well known in the art and are not further discussed.

Figure 8B:
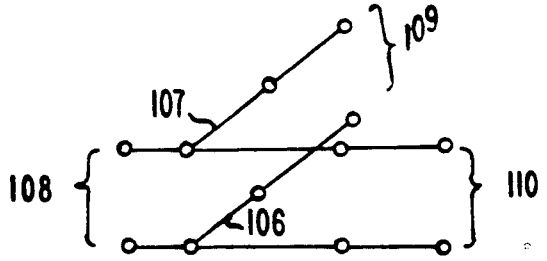
FIGS. 8*a* and 8*b* present a transition technique usable in the invention for coupling the feed system to a geodesic lens antenna.
Figure 8A:
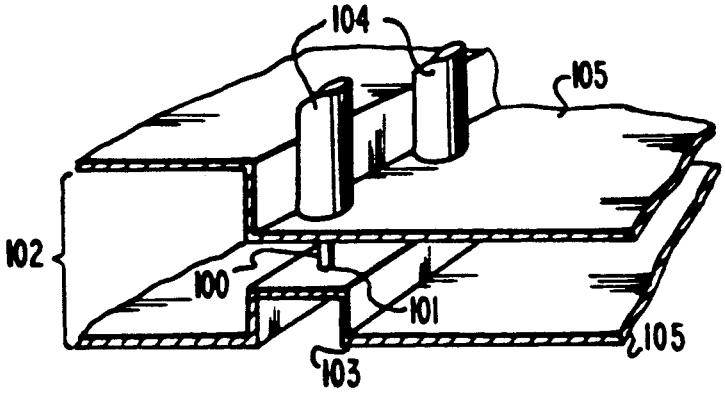

Coupling of the input feeds to the optical multiple beam antenna can be critical in that frequency bandwidth and power handling capabilities can be affected. Coupling can be accomplished by using techniques such as a waveguide transition, a dumb-bell probe, a shorted probe, a loop and others known in the art. To achieve a focussing of the beams, the fixed phase center of the feed is placed on the focal curve of the optical multiple beam antenna. A shorted probe technique applied to a geodesic lens antenna is shown in FIG. 8a. This technique is suitable for coaxial inputs such as coax 104 and uses a conventional stepped impedance transformer 103. For in-phase excitation, one can define a "cell" in the lens having spacing equal to the probe spacings; the sides may be considered to be magnetic walls, and top and bottom the electric walls. The impedance $Z_O$ of this cell is:

$$Z_0 = \left(\frac{\mu}{\epsilon}\right)^{\frac{1}{2}} \frac{s}{a}$$

where:

a = the probe spacing s = the plate separation $$\left(\frac{\mu}{\epsilon}\right)^{\frac{1}{2}} = \text{impedance of space (377 ohms)}$$

A broadband perpendicular transition is shown in FIG. 8*a* where the probe 100 extends across the spacing between the plates 105 and is shorted at the bottom 101. A loaded, high impedance 102 is placed on one side and impedance step 103 is located in the coax 104 and/or in the parallel plates 105 as shown in FIG. 8*a*. There are other transitions known to those skilled in the art which will also function in the invention. However, it is believed that the design shown in FIG. 8*a* is of particular practical importance because it has a distinct frequency independent phase center located at the opening to the high impedance section 102. FIG. 8*b* presents a schematic diagram of the electrical equivalent circuit of a transition where there is a two step transformer using lines 106 and 107 and an infinite impendance 108, a 50 ohm impedance input 109, and the parallel plate impedance at 110. Waveguide coupling is of practical use in the invention and techniques for the broadband matching of phased array antennas are applicable to the invention as well. For a more detailed discussion of transitions, refer to Ragan, *Radiation Laboratory Series*, Vol. 9, pgs. 314–405.

Feeding a Luneberg lens antenna such as lens 80 of FIG. 6 is accomplished by feed means such as truncated waveguides, probes or other feed means known in the art. Also shown in FIG. 6 is power divider 86, amplitude weighting device 87, phasing control 88 and aperture control 89.

Phasing control device (88 as shown in FIG. 6 and 92 as shown in FIG. 7), is used in the invention to control beam ripple. In the Woodward approach, the correct power is obtained at the sample points regardless of phase since theoretically only one beam contributes to the outputs at these points. However practically, interbeam phase shift can be used to control the pattern ripple at the crossover level of the constituent beams. For uniformly shaped sectoral beams, it has been found that the ripple away from the edges is insensitive to the chosen phase progression. Varying the phase can result in less ripple near the beam edges. Phasing control devices usable in the invention include posts or buttons in waveguide, line lengths, shunt stubs in stripline, dielectric slugs and others known in the art.

Figure 9:
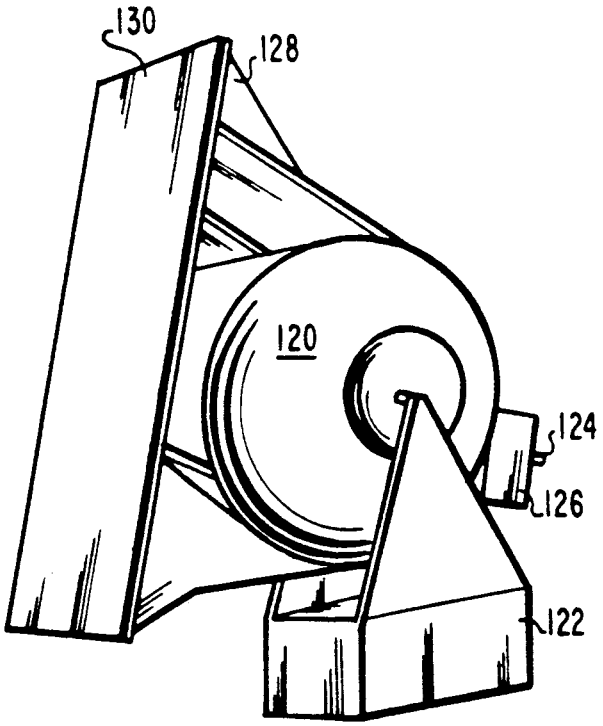
FIG. 9 presents a perspective view of an antenna constructed in accordance with the invention wherein a geodesic lens has an E-plane sectoral horn and is mounted, on a pedestal.

FIG. 9 presents a perspective view of an antenna constructed in accordance with the invention, wherein a geodesic lens antenna 120 is mounted in a stabilizing pedestal 122. A coaxial feedline 124 enters power divider, amplitude weighting and phase control devices which are located in a cabinet 126. The typical contents of the cabinet 126 are shown schematically in FIG. 7 as power divider 90, amplitude weighting means 95 and phase control means 92. As required, the stabilizing pedestal 122 is a fixed mounting or a moveable mounting such as where it must compensate for ship pitch and roll. The aperture horn 128 is a sectoral horn for narrowing the beam and has a dielectric sheet 130 covering its external opening for weather protection.

In the antenna shown in FIG. 9, relatively high power levels may be conducted since the geodesic lens antenna is a parallel plate, air dielectric lens antenna. The power handling capabilities are critically affected by the input feed system shown as shorted probe 100 in FIG. 8*a*. A design such as that shown in FIG. 8*a* will result in efficient power transfer from the feed system to the geodesic lens. Matching of the geodesic lens to the feed may be accomplished by techniques known to those skilled in the art. One technique is shown in FIG. 8*a* where a stepped plate transformer 103 is used.

Another consideration in the use of a geodesic lens antenna in the invention is the plate spacing. If the plate spacing is maintained at less than one half wavelength, and the lens radius is much greater than one wavelength, then the geodesic lens antenna will function according to optical theory. Another consideration with any geodesic analog to a Luneberg lens is the technique for bending the rays which leave the dome shaped surface. Typically, a toroidal bend is used, however it has been found that mitered bends (also usable in the circular folded pillbox antenna) function in accordance with optical theory. Compensation for the defocusing caused by the introduction of the bends is accomplished by techniques known to those skilled in the art. For a more detailed discussion, refer to H. Jasik, *Antenna Engineering Handbook*, McGraw-Hill, 1961, pgs. 15-6 to 15-8 and R. C. Johnson, "The Geodesic Luneberg Lens", The Microwave Journal, Aug. 1962, pgs. 76-85.

Figure 11:
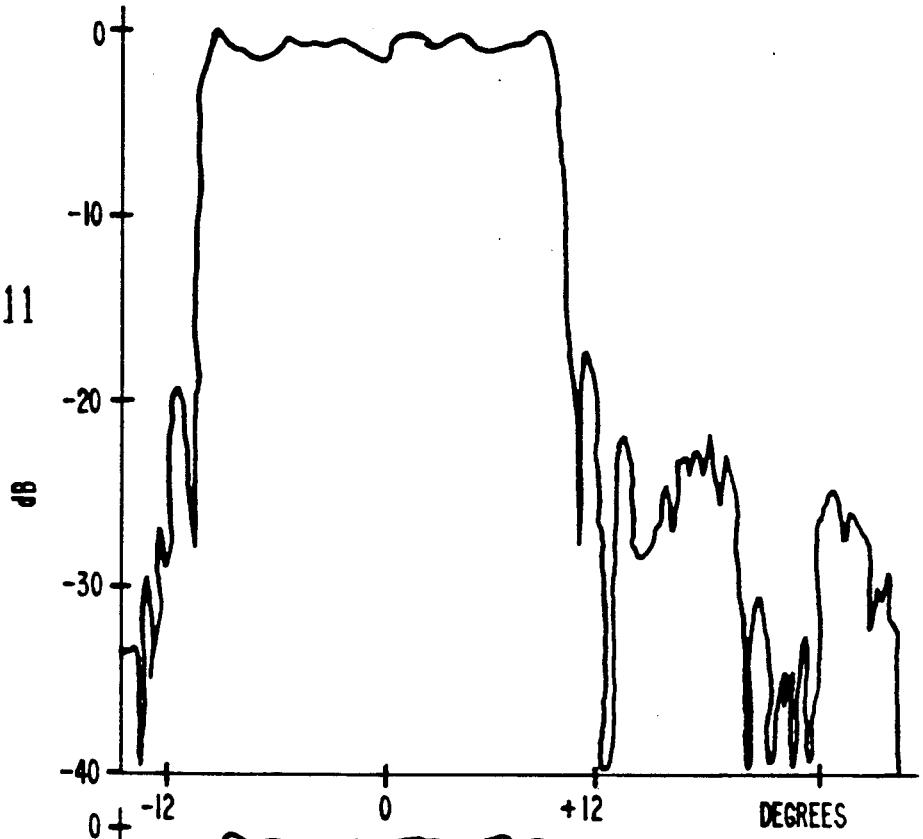
FIG. 11 presents a graph of a radiation pattern of an embodiment of the invention at twice the frequency of FIG. 10.
Figure 10:
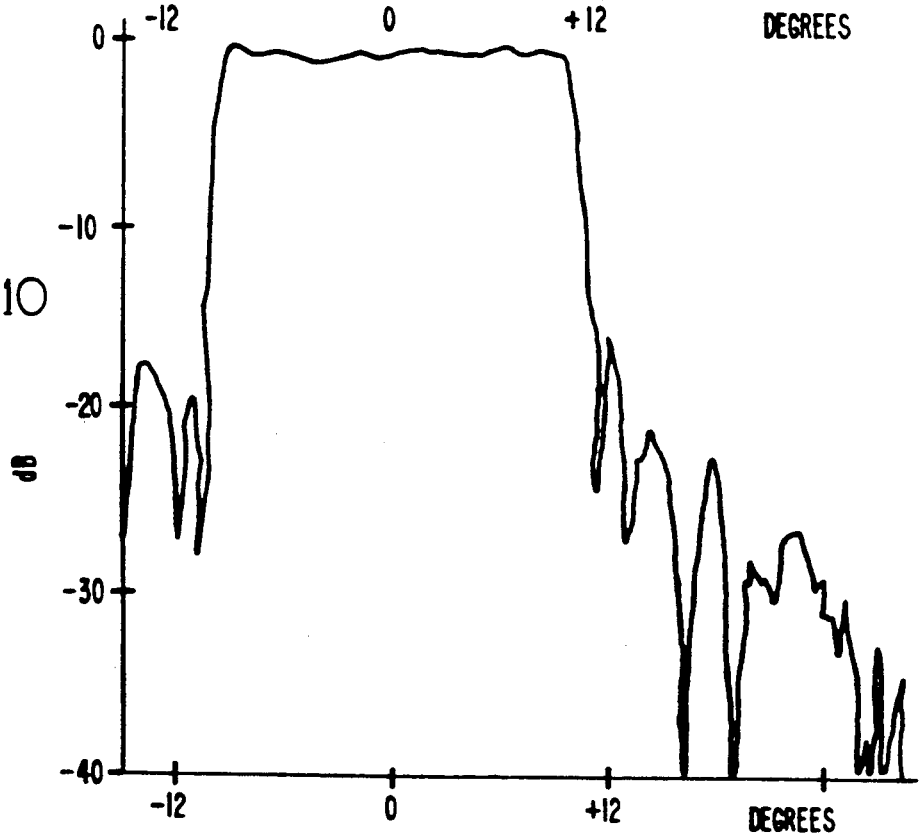
FIG. 10 presents a graph of a radiation pattern of an embodiment of the invention at one frequency.

An embodiment of the invention was built to operate in the 14.5 to 17.0 GHz frequency band. A waveguide power divider and a geodesic lens which was fitted with an E-plane sectoral horn were interconnected using coaxial cables and transitions similar to that discussed above and shown in FIG. 8a. Line lengths were used to control the relative phasing. Patterns obtained show the steep beam edge slope as predicted as well as the constant beamwidth instead of the usual proportionality between beamwidth and wavelength obtained using prior techniques. Edge slope was measured at 12.5 dB/degree in an embodiment using a 96.52 cm (38 inch) geodesic lens antenna and one half wavelength spaced probes along a 20° arc on the feed circle. This configuration yielded a beamwidth in the far field of 19.4°, and ripple was measured at ±0.3 dB at 14.5 GHz as shown in FIG. 10. At 17.0 GHz, the ripple increased to ±0.8 dB/degree, the beam width was 19.9 degrees and the edge slope was 13.3 dB/degree as shown in FIG. 11. A phenomenon noticed in this embodiment was that the sector beamwidth, measured between the 3 dB points, remained nearly constant even though the operating frequency was changed by a factor of approximately 5/4, and the constituent beams changed shape.

Thus, there has been shown and described a new and useful wideband shaped beam antenna. Rather than attempting to shape a single beam into a sector beam, the invention provides an overlapped plurality of selected single beams which form the sector beam. The sector beam edges are, effectively, the edges of two single beams. The principal advantages of the invention are the ability to maintain a constant prescribed beam position and beam shape over an octave frequency bandwidth with steep beam edge slopes in one plane. The beam edge slope is proportional to kD instead of the less steep $(kD)^{\frac{1}{2}}$ relationship common to direct radiating antennas used in the past. The invention is also capable of handling high power levels. Since the feed design can be a loaded waveguide, the power levels can be made extremely high. In the case of a geodesic lens antenna, most of the transmission path is in air, therefore loss is low. Geodesic lenses are relatively inexpensive to construct. Beam ripple and edge slope can be controlled over octave frequency bandwidth by the use of phasing control at the lens inputs and by using an imperfectly focussing lens.

Although described in a shipboard application with steep beam edges being placed in the elevation plane, there are other uses both active and passive, which will benefit from the present invention. Any system which requires a constant shaped sector beam in one plane and which must operate over wide frequency bandwidths can employ the present invention. The characteristic of a wide frequency bandwidth may also make the invention desirable to an application where the antenna is shared between two or more narrow frequency band systems having widely separated center frequencies. This feature may be important to a shipboard application where lofty antenna sites are scarce and the present antenna could be used to share two or more communication systems.

Although the invention has been described and illustrated in detail, this is by way of example only and is not meant to be taken by way of limitation. Modifications to the above description and illustrations of the invention may occur to those skilled in the art, however it is the intention that the scope of the invention should include such modifications unless specifically limited by the claims.

What is claimed is:

1. An antenna system or providing a frequency independent shaped sector beam in space, comprising:

a multiple beam antenna having multiple feed points, each of which forms a corresponding frequency independent beam in space, the feed points being selected so that the beams overlap to form said sector beam;

dividing means for dividing a signal into a plurality of feed signals, predetermined ones of which are selected such that one particular feed signal feeds one of the feed points;

phase means for selectively controlling the relative phase of the predetermined ones of the feed signals to result in a predetermined ripple between adjacent beams; and transition means for simultaneously applying the predetermined ones of the feed signals to the respective feed points.

2. The antenna system according to claim 1 wherein said feed points are spaced from each other by one-half wavelength.

3. The antenna system according to claim 1 further comprising aperture means for controlling the beamwidth of the beams in the plane orthogonal to the plane of the multiple beams.

4. The antenna system according to claim 1 further comprising amplitude means for amplitude weighting selected feed signals of said plurality of feed signals.

5. The antenna system according to claim 1 wherein said multiple beam antenna is selected from the group consisting of geodesic lens antennas and Luneberg lens antennas.

6. The antenna system according to claim 1 wherein said multiple beam antenna is selected from the group consisting of circular folded pillbox antennas, constant dielectric lens antennas and trash can scanner antennas.

7. The antenna system according to claim 5 further comprising aperture means for controlling the beamwidth of the beams in the plane orthogonal to the plane of the multiple beams.

8. The antenna system according to claim 7 wherein said aperture means comprises a sectoral horn coupled to the multiple beam antenna.

9. The antenna system according to claim 7 wherein said transition means comprises a shorted coaxial probe transition which couples the feed signal to the feed point.

10. The antenna system according to claim 9 wherein said transition means further comprises transformer means for transforming the impedance of the shorted coaxial probe to the impedance of the multiple beam antenna at the feed point.

11. The antenna system according to claim 10 wherein said transformer means comprises a stepped impedance transformer disposed in the multiple beam antenna.

12. The antenna system according to claim 9 wherein said transition means further comprises a high impedance device coupled to said shorted coaxial probe.

13. The antenna system according to claim 6 further comprising aperture means or controlling the beamwidth of the beams in the plane orthogonal to the plane of the multiple beams.

14. The antenna system according to claim 13 wherein said aperture means comprises a sectoral horn coupled to the multiple beam antenna.

15. The antenna system according to claim 5 further comprising amplitude means for amplitude weighting selected feed signals of said plurality of feed signals.

16. The antenna system according to claim 6 further comprising amplitude means for amplitude weighting selected feed signals of said plurality of feed signals.

17. An antenna system for providing a frequency independent shaped sector beam in space, comprising:

a multiple beam antenna having multiple feed points, each of which forms a corresponding frequency independent beam in space, the feed points being selected so that the beams overlap to form the sector beam;

a feed apparatus coupled to the multiple beam antenna for feeding a plurality of feed signals to and from the multiple beam antenna, comprising:

i) signal divider/combiner means for dividing a single signal into a plurality of feed signals, predetermined ones of which are selected such that one particular feed signal feeds one of the feed points, and for combining the feed signals into a single signal;

ii) phasing control means for controlling the relative phase of the predetermined ones of the feed signals to result in a predetermined ripple between adjacent beams;

iii) transition means for simultaneously applying the predetermined ones of the feed signals to the respective feed points; and iv) aperture control means for controlling the beamwidth of the beams in the plane orthogonal to the plane of the multiple beams.

18. The antenna system according to claim 17 wherein the multiple beam antenna comprises a perfectly focussing multiple beam antenna.

19. The antenna system according to claim 18 wherein said perfectly focussing multiple beam antenna is selected from the group consisting of geodesic lens antennas and Luneberg lens antennas.

20. The antenna system according to claim 19 wherein said transition means comprises a shorted coaxial probe transition which couples the feed signal to the feed point.

21. The antenna system according to claim 18 wherein said aperture control means comprises a sectoral horn coupled to the perfectly focussing multiple beam antenna.

22. The antenna system according to claim 17 wherein the multiple beam antenna comprises an imperfectly focussing multiple beam antenna.

23. The antenna system according to claim 22 wherein the imperfectly focussing multiple beam antenna is selected from the group consisting of circular folded pillbox antennas, constant dielectric lens antennas and trash can scanner antennas.

24. The antenna system according to claim 23 wherein said aperture control means comprises a sectoral horn coupled to the imperfectly focussing multiple beam antenna.

25. An antenna system for providing a shaped frequency independent sector beam in space, comprising:

a geodesic lens antenna having spacing between its conducting surfaces of no greater than one-half wavelength whereby only the TEM mode is propagated, said geodesic lens antenna having a plurality of feed points disposed on its focal curve in selected positions for simultaneously forming multiple overlapping beams in space to form said frequency independent sector beam;

a feed apparatus coupled to said geodesic lens antenna for feeding a plurality of signals to and from the geodesic lens antenna, comprising:

i) signal divider/combiner means for dividing a single signal into a plurality of feed signals, predetermined ones of which are selected such that a particular feed signal feeds one of the feed points and for combining the feed signals into a single signal;

ii) phasing control means coupled to the predetermined ones of the feed signals for controlling the relative phase of the predetermined ones of the feed signals to result in a predetermined ripple between adjacent beams;

iii) transition means for coupling the predetermined ones of the feed signals to said respective feed points on the focal curve of the geodesic lens antenna, said transition means comprising a coaxial shorted probe disposed between the conducting plates of said geodesic lens antenna; and iv) aperture control means coupled to the geodesic lens antenna for controlling the beamwidth of the beams in the plane orthogonal to the plane of the multiple overlapping beams, comprising a sectoral waveguide horn.

* * * * *